United States Patent [19]

Dobbs

[11] 4,329,954

[45] May 18, 1982

[54] ENGINE SHUT-DOWN DEVICE

[76] Inventor: Odis L. Dobbs, 5840 Dahlia St., Commerce City, Colo. 80022

[21] Appl. No.: 139,983

[22] Filed: Apr. 14, 1980

[51] Int. Cl.[3] ..... F02B 77/08

[52] U.S. Cl. ..... 123/198 D; 123/198 DB

[58] Field of Search ..... 123/198 D, 198 DB

[56] References Cited

U.S. PATENT DOCUMENTS 2,112,664 3/1938 Dube ..... 123/198 DB 2,315,715 4/1963 Leibing ..... 123/198 DB 3,153,403 10/1964 Dobbs ..... 123/198 DB X

*Primary Examiner*—Tony M. Argenbright

[57] ABSTRACT

An improved engine shut-down device is provided which includes a pressure responsive modular unit wherein an oil pressure responsive device normally prevents a fuel pressure responsive device from actuating an engine shut-down control. Both the oil pressure device and fuel pressure device include bellows actuators which minimize the possibility of fluid leakage and extend the life of the device.

2 Claims, 1 Drawing Figure

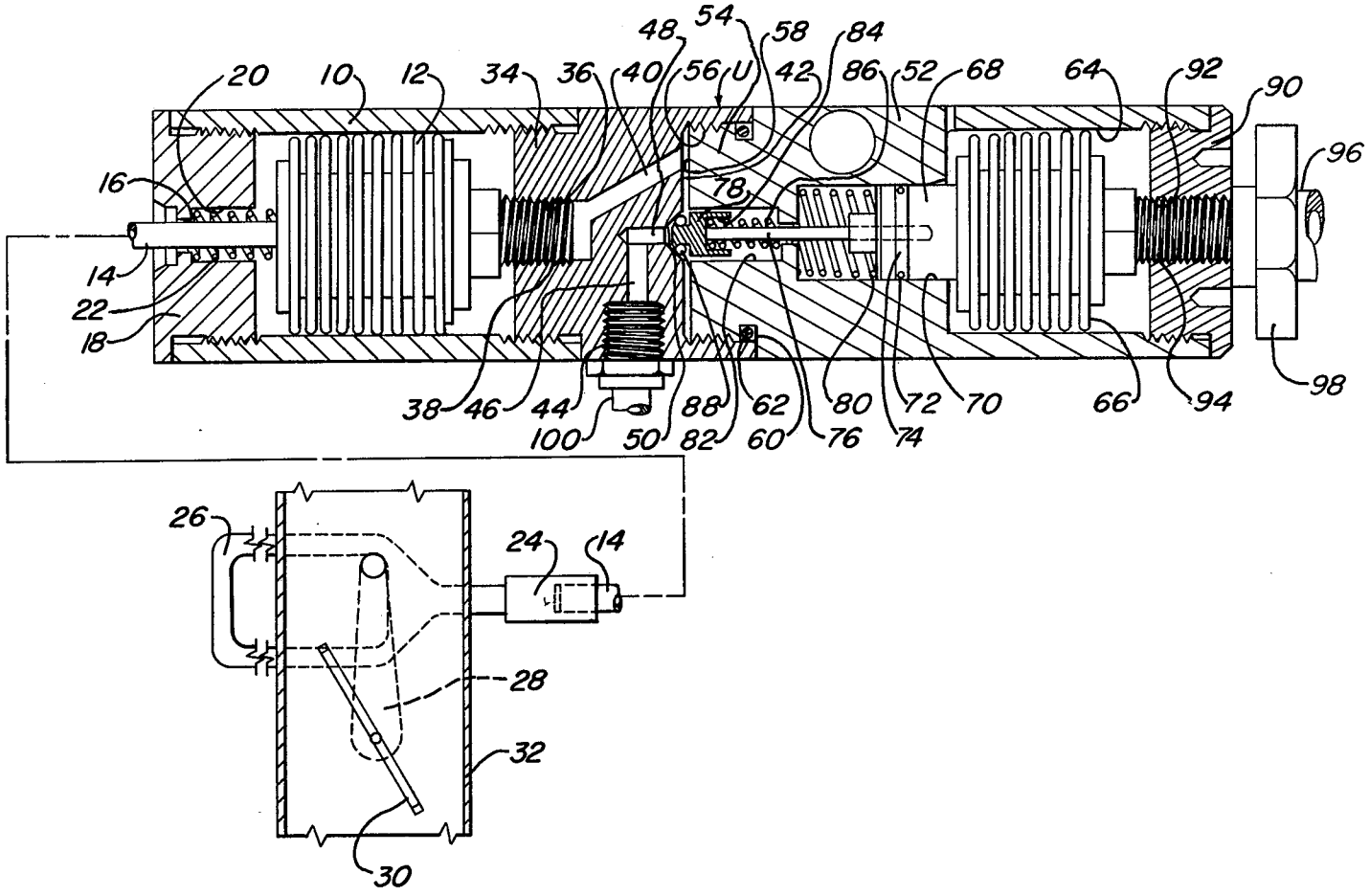
96
98
90
92
94
64
66
68
70
52
72
74
84
86
80
76
58
42
62
60
54
U
78
88
82
56
48
40
50
36
100
44
34
46
38
12
10
20
16
14
22
18
14
24
28
32
30
26

ENGINE SHUT-DOWN DEVICE

DESCRIPTION

TECHNICAL FIELD

This invention relates to an improved engine shut-down device and more particularly to a shut-down device which includes bellows actuators in a modular unit.

BACKGROUND ART

This invention is an improvement over the engine shut-down system disclosed in my U.S. Pat. No. 3,153,403 entitled "Engine Shut-Down System", which issued on Oct. 20, 1964. That device included a cylinder to which engine oil pressure was supplied, thereby forcing a piston within the cylinder to seat a ball valve so that engine fuel pressure supplied to the other end of the cylinder would normally not be supplied to a second cylinder and piston arrangement which would operate a shut-down device. However, should oil pressure drop below a predetermined level, the ball valve would open allowing fuel pressure to displace the piston in the second cylinder thereby closing an air intake to the engine and shutting it down. The pistons within both cylinders were provided with O-rings to minimize leakage of fluid past the pistons. However, it was found that in operation the pistons would vibrate considerably due to momentary changes in oil pressure. This would cause the O-rings to become heated due to friction and stick to the cylinder walls resulting in rapid deterioration of the O-rings at an unacceptably fast rate and also resulting in leakage of oil past the pistons into other parts of the cylinder. Thus, considerable maintenance expense was incurred due to this leakage.

Also, my prior art device included a spring which normally held the ball valve closed during initial rise in oil pressure so that the engine would not immediately shut down. However, should the fuel pressure, which builds up almost instantaneously, reach full pressure before the oil reached full pressure, the ball valve might be opened against the force of the spring causing the device to shut down the engine. This is a highly undesirable situation which causes much irritation to the engine operator in trying to keep the engine operating during build up of the oil pressure.

DISCLOSURE OF THE INVENTION

In accordance with this invention, an improved engine shut-down device is provided for use in an internal combustion engine having both fuel and oil supplied under pressure and including an engine shut-down device. A pressure responsive unit for shutting the engine down operates in response to a drop of oil pressure below a predetermined limit. This unit comprises a fuel pressure inlet and an oil pressure inlet, a first bellows connected to the fuel pressure inlet and responsive to fuel pressure, the bellows also being connectable to the engine shut-down device. A pressure valve is located between the fuel pressure inlet and the first bellows. A second bellows is connected between the oil pressure inlet and the pressure valve and is responsive to oil pressure to maintain the valve in closed position.

More particularly, the pressure responsive unit is formed in convenient modules having a power end cap at one end through which the first bellows activating rod extends, a power end section containing the first bellows connected to the power end cap, a mid-section module containing fuel pressure ports from the fuel pressure inlet to the pressure valve and from the pressure valve to the first bellows. The device also includes an oil section module connected to the mid-section containing the pressure valve and the second bellows. Finally, an oil end cap completes the unit and is provided with the oil pressure inlet.

The improved engine shut-down device of this invention through the use of bellows means greatly minimizes the chance of fluid pressure passing to unwanted portions of the device or from leaking out of the device onto the engine. In addition, the unit is quite compact, being formed in modular form which facilitates manufacture and replacement of any defective parts.

Additional advantages of the invention will become apparent from the description which follows, taken in conjunction with the accompanying drawings.

BRIEF DESCRIPTION OF THE DRAWINGS

The drawing is a longitudinal section through the pressure responsive unit and pressure delay device of this invention, with certain parts broken away for clarity of illustration, the pressure delay device being shown in its initial position before engine start up.

BEST MODE FOR CARRYING OUT THE INVENTION

In accordance with this invention, a pressure responsive unit U is provided which is of modular construction and has first and second inlets for sensing fuel pressure and oil pressure respectively from an internal combustion engine. Should the oil pressure in the engine drop below a predetermined level, the fuel pressure is used to activate an engine shut-down device. This shut-down device could be used to short out the ignition system, to disengage the transmission, but is illustrated in this application as used to control a valve on an air intake for the engine.

The pressure responsive unit U includes a power end section comprising a cylindrical housing 10 for containing a fuel pressure responsive bellows 12 having an arm or push rod 14 which extends through an opening 16 in a power end cap 18 which is attached to one end of housing 10 as by threads, as shown. Conveniently, end cap 18 includes a counter bore 20 concentric with opening 16 for receiving a coil spring 22 which urges push rod 14 toward the right as viewed in the drawing and tends to collapse bellows 12. The push rod is connected by a coupling 24 to a lost motion device 26 which in turn is operatively connected to a control arm 28 which will pivot damper 30 to a closed position across air intake 32 upon the application of fuel pressure to bellows 12, in a manner to be described. This causes push arm 14 to move to the left, as viewed in the drawing, against the force of coil spring 22.

A center port section or mid-section module 34 is threadably attached to the opposite end of housing 10 and includes a threaded port 36 which is threadably and sealingly connected to pressure port 38 of fuel pressure bellows 12. Port 36 is connected by means of passageway 40 to the opposite face 42 of port section 34. A fuel pressure inlet 44 is provided in the side of port section 34 and is connected by passageways 46 and 48 to face 42, as shown in the drawing. A valve seat 50 is provided in face 42 at port 48 for a purpose to be described below.

An oil section module 52 has a projecting threaded portion 54 which is threadably interconnected with a threaded bore 56 which terminates at base 42. Conveniently, the length of threaded portion 54 is less than the depth of bore 56 so that when modules 34 and 52 are connected together, a space will be provided between face 42 and face 58 of module 52. Advantageously, portion 54 is provided with a groove 60 at the base thereof for receiving an O-ring 62 to provide a tight seal adjacent the engagement of the threads to prevent fluid leakage therebetween.

The oil section 52 has a central bore 64 within which is received the oil pressure responsive bellows 66. The bellows is provided with a cylindrical extension 68 which is mounted in recess 70 and held in sealing relationship therein by means of O-ring 72 in groove 74, as shown. A drive pin 76 is slidably received in extension 68 for pushing valve 78 against valve seat 50 upon oil pressure expanding bellows 66 against the force of coil spring 80 in recess 70.

Conveniently, valve seat 78 is received within a bore 82 and has a socket 84 for receiving the end of drive pin 76 as well as coil spring 86 whose opposite end bears against the end of bore 82. Valve 78 is conveniently provided with an O-ring 88 which provides a seal between passageway 48 and the space between faces 42 and 58.

The modular pressure responsive unit U is completed by an oil end cap 90 which is threadably received in the opposite end of oil section 52 so as to enclose bellows 56. The end cap is provided with a threaded port 92 which is received in threading engagement on oil pressure port 94 of the bellows. Conveniently, an oil pressure line 96 can be connected to port 92 through a suitable coupling 98.

In normal operation of an internal combustion engine, oil pressure is applied to and expands bellows 66 against the force of spring 80. This causes push rod 76 to maintain valve 78 in sealed position against valve seat 50 thereby preventing gas pressure, which is supplied through inlet 44, from reaching bellows 12. Thus, damper 30 will stay in the open position as shown. However, should oil pressure drop below a predetermined level, then the gas pressure will displace valve 78 against the force of coil spring 86 causing the valve to be open and gas pressure to flow from passage 48 through the space between faces 42 and 58 into passageway 40 so as to apply pressure to bellows 12. This will cause bellows 12 to expand and cause push rod 14 to move to the left, as viewed, thereby pivoting control arm 28 to close damper 30 across air inlet 32 and shut down the engine operation before serious damage can be caused to the engine due to the loss of oil pressure. Valve 78 will remain closed even when the oil pressure drops unless the fuel pressure is above a predetermined level so as to force valve 78 open against the force of spring 86. This assures that duringnormal shut down of the engine wherein both fuel pressure and oil pressure drop, valve 78 will remain closed for the next start-up operation.

From the foregoing, the advantages of this invention are readily apparent. A pressure responsive unit has been provided which has a modular construction and through the use of bellows is very reliable in operation. The device provides for automatic shut-down of an internal combustion engine upon loss of oil pressure or the dropping of oil pressure below a predetermined limit.

The invention has been described in detail with particular reference to preferred embodiments thereof, but it will be understood that variations and modifications can be effected within the spirit and scope of the invention.

I claim:

1. A modular pressure responsive unit for use in an engine shut-down device and which is responsive to engine oil pressure and fuel pressure, wherein the engine is shut down when the pressure responsive unit senses a drop in engine oil pressure below a predetermined limit, said modular unit comprising:

a tubular power end section;

a first bellows mounted in said power end section and expandable in response to fuel pressure;

a power end cap removably connected to one end of said power end section and having a central opening therein;

a push rod extending through said power end cap and having a first end connected to said first bellows and a second end connectable to the engine shut-down device, said push rod being movable in response to movement of said first bellows;

means in said power end section normally maintaining said first bellows in collapsed condition;

a mid-section having one end removably connected to the opposite end of said power section, having a fuel pressure inlet in one side thereof in fluid communication with a valve seal in a face on the opposite end of said mid-section and a passageway in fluid communication with said first bellows and said opposite end of said mid-section;

tubular oil section having one end removably connected to said other end of said mid-section and having a face spaced from the face of said mid-section;

a second bellows mounted in said oil section and expandable in response to oil pressure;

a pressure valve connected to said second bellows and movable therewith to normally bring said valve into engagement with said valve seat;

an oil end cap removably connected to the opposite end of said oil section having an oil pressure inlet therein in fluid communication with said second bellows normally urging said pressure valve into closed position against said valve seat; and means urging said second bellows toward a collapsed position in response to a drop in oil pressure below a predetermined amount to open said pressure valve allowing fluid pressure to flow through the spaces between said faces and expand said first bellows to move said push-rod to shut down the engine.

2. A pressure responsive unit, as claimed in claim 1, wherein said maintaining means includes:

spring means between said power end cap and said first bellows for urging said first bellows toward collapsed position to maintain the engine shut-down device in inoperative condition;

and said urging means further includes:

a pin extending between said pressure valve and said second bellows for holding said valve in closed condition in response to oil pressure expanding said second bellows;

a first spring in said oil section urging said second bellows in a direction away from said valve for collapsing said second bellows upon a drop of said oil pressure below a predetermined amount; and a second spring in said oil section normally urging said valve toward closed position against said fuel pressure so that upon drop of said oil pressure, said valve remains closed unless said fuel pressure is above a predetermined amount.

* * * * *